US011493230B2

(12) United States Patent
Jang et al.

(10) Patent No.: US 11,493,230 B2
(45) Date of Patent: Nov. 8, 2022

(54) AIR CONDITIONER

(71) Applicant: SAMSUNG ELECTRONICS CO., LTD., Suwon-si (KR)

(72) Inventors: Keun Jeong Jang, Yongin-si (KR); Chur Ju Lee, Seoul (KR); Yong-Sam Kwon, Suwon-si (KR); Jang Jung Lee, Hwaseong-si (KR); Eun Sung Jo, Seoul (KR); Jong Moon Kim, Hwaseong-si (KR); Hyeong Joon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 193 days.

(21) Appl. No.: 16/762,993

(22) PCT Filed: Jan. 31, 2018

(86) PCT No.: PCT/KR2018/001314
§ 371 (c)(1),
(2) Date: May 11, 2020

(87) PCT Pub. No.: WO2019/093583
PCT Pub. Date: May 16, 2019

(65) Prior Publication Data

US 2020/0309405 A1 Oct. 1, 2020

(30) Foreign Application Priority Data

Nov. 10, 2017 (KR) ..... 10-2017-0149069

(51) Int. Cl.
*F24F 1/0014* (2019.01)
*F24F 13/14* (2006.01)
(Continued)

(52) U.S. Cl.
CPC ..... *F24F 13/14* (2013.01); *F24F 1/0014* (2013.01); *F24F 1/0018* (2013.01);
(Continued)

(58) Field of Classification Search
CPC ..... F24F 13/14; F24F 1/0063; F24F 1/0014; F24F 1/0018; F24F 13/06; F24F 13/081;
(Continued)

(56) References Cited

U.S. PATENT DOCUMENTS

2010/0206514 A1* 8/2010 Liu ..... F24F 13/20 165/67

FOREIGN PATENT DOCUMENTS

EP 1 553 358 1 7/2005
EP 2835597 A1 * 2/2015 ..... F24F 1/0011
(Continued)

OTHER PUBLICATIONS

Higashichi, Hiroaki, JP2010048492 Translation, "Wind direction guide device for air conditioner", Mar. 2004, pp. 1-29.*
(Continued)

*Primary Examiner* — Avinash A Savani
*Assistant Examiner* — Ryan L Faulkner
(74) *Attorney, Agent, or Firm* — Staas & Halsey LLP

(57) ABSTRACT

Disclosed is an air conditioner, and more particularly, to an air conditioner having an airflow guide to make the flow of discharged air uniform.

An air conditioner comprising a housing having a suction port and a discharge port, a heat exchanger arranged inside the housing, a blower fan configured to suck in air through the suction port, force the air to be subject to heat exchange with the heat exchanger, and discharge the heat-exchanged air through the discharge port, a first blade pivotally arranged to open or close the discharge port and having a first face and a second face opposite of the first face, a first
(Continued)

flow path formed between the discharge port and the first face, a second flow path formed between the discharge port and the second face, a second blade movably installed inside the housing and a third blade formed to protrude from the second blade to guide air to the first flow path and the second flow path.

11 Claims, 16 Drawing Sheets

(51) Int. Cl.

| | |
|---|---|
| ***F24F 1/0063*** | (2019.01) |
| ***F24F 1/0018*** | (2019.01) |
| ***F24F 13/06*** | (2006.01) |
| ***F24F 13/08*** | (2006.01) |
| ***F24F 13/20*** | (2006.01) |
| *F24F 1/0047* | (2019.01) |

(52) U.S. Cl.
CPC ..... *F24F 1/0063* (2019.02); *F24F 13/06* (2013.01); *F24F 13/081* (2013.01); *F24F 13/20* (2013.01); *F24F 1/0047* (2019.02); *F24F 2013/205* (2013.01)

(58) Field of Classification Search
CPC .... F24F 13/20; F24F 1/0047; F24F 2013/205; F24F 13/08; F24F 13/10; F24F 13/1413; F24F 13/1486; F24F 13/15; B60H 1/00871; B60H 1/34; B60H 1/00835
USPC ..... 454/313
See application file for complete search history.

(56) References Cited

FOREIGN PATENT DOCUMENTS

| | | | |
|---|---|---|---|
| JP | S61 29221 | U | 2/1986 |
| JP | 8-159509 | A | 6/1996 |
| JP | 10-19300 | A | 1/1998 |
| JP | 2003-21386 | A | 1/2003 |
| JP | 2003-130386 | | 5/2003 |
| JP | 2009-109100 | | 5/2009 |
| JP | 2009-109100 | A | 5/2009 |
| JP | 2010-48492 | | 3/2010 |
| KR | 10-1999-0001116 | | 1/1999 |
| KR | 10-2000-0056700 | | 9/2000 |
| KR | 10-1362317 | B1 | 2/2014 |
| KR | 10-1429427 | B1 | 8/2014 |

OTHER PUBLICATIONS

Extended European Search Report dated Oct. 26, 2020, in corresponding European Patent Application No. 18875059.0.
Form PCT/ISA/210; International Search Report dated Aug. 2, 2018 in International Patent Application No. PCT/KR2018/001314.
Chinese Office Action dated Apr. 6, 2021, in corresponding Chinese Patent Application No. 201811299377.6.
Office Action dated Sep. 6, 2021, in Chinese Application No. 201811299377.6.
Office Action dated Feb. 15, 2022, in Chinese Application No. 201811299377.6.
Office Action dated Jun. 7, 2022, in Korean Application No. 10-2017-0149069.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/001314 filed on Jan. 31, 2018, which claims foreign priority benefit under 35 U.S.C. § 119 of Korean Patent Application No. 10-2017-0149069 filed on Nov. 10, 2017, in the Korean Intellectual Property Office, the contents of both of which are incorporated herein by reference

TECHNICAL FIELD

The present disclosure relates to an air conditioner, and more particularly, to an air conditioner having an airflow guide to make the flow of discharged air uniform.

BACKGROUND ART

In general, an air conditioner is a home appliance to keep indoor air at a pleasant temperature by using a refrigeration cycle of a refrigerant, and includes an indoor unit, which is located indoors, having a heat exchanger and a blower fan, an outdoor unit, which is located outdoors, having a heat exchanger, a blower fan, a compressor, a condenser, and the like, and a refrigerant tube connecting the indoor unit and the outdoor unit for circulating the refrigerant.

The air conditioner may be classified by the place to install the indoor unit into a stand-type air conditioner with the indoor unit standing on the floor and a wall-hanging air conditioner with the indoor unit mounted on the wall, and a ceiling type air conditioner with the indoor unit mounted on the ceiling. The ceiling type air conditioner may have the indoor unit buried in or hung on the ceiling.

Since the indoor unit of the ceiling type air conditioner is installed on the ceiling, the suction port to suck in indoor air and the discharge port to discharge the air, which has been heat-exchanged by the heat exchanger, back into the indoor space are arranged in the bottom portion of the main body. The indoor unit of the ceiling type air conditioner may further be classified by the number of discharge ports into a 1-way type with one discharge port and a 4-way type with a rectangular discharge port.

Typically, the indoor unit of the air conditioner has a blade provided in the discharge port to regulate the discharge direction of the heat-exchanged air. The blade is pivotally coupled on a side of the discharge port. The blade is coupled with a motor and rotated by receiving rotational force generated by the motor.

The blade may include a V-blade for discharging air flowing through the discharge port to the left and right of the discharge port.

However, this type of blade cannot uniformly distribute the discharged air, causing some local high-speed movement, which increases a pressure loss and thus reduces air volume and leads to distribution failure of cold air and thus dew condensation on the surface of the blade.

DISCLOSURE OF INVENTION

Technical Problem

The present disclosure provides an air conditioner having an airflow guide to make the flows of discharged air uniform.

The present disclosure also provides an air conditioner to improve distribution of discharged air flows to reduce dew condensation.

The present disclosure also provides an air conditioner to make movement of discharged air uniform to increase air volume.

Solution to Problem

In accordance with an aspect of the embodiments, an air conditioner comprising: a housing having a suction port and a discharge port; a heat exchanger arranged inside the housing; a blower fan configured to suck in air through the suction port, force the air to be subject to heat exchange with the heat exchanger, and discharge the heat-exchanged air through the discharge port; a first blade pivotally arranged to open or close the discharge port and having a first face and a second face opposite of the first face; a first flow path formed between the discharge port and the first face; a second flow path formed between the discharge port and the second face; a second blade movably installed inside the housing; and a third blade formed to protrude from the second blade to guide air to the first flow path and the second flow path.

The third blade is formed to be perpendicular to the second blade.

The third blade is formed in the plural.

The third blade is arranged to be above the second blade.

The third blade comprises a curved plane.

The third blade is formed to have the form of a plate.

The third blade comprises a blade body; a first guide face forming a front face of the blade body; and a second guide face forming a rear face of the blade body.

The first guide face is formed to guide air to the first flow path and the second guide face is formed to guide air to the second flow path.

The third blade is formed to incline from the second blade.

The housing comprises a frame arranged therein, wherein at least one inner side of the frame has first curvature, and wherein the third blade has a curved plane with the first curvature.

The third blade is arranged at the rear end of the second blade.

The third blade is formed to protrude from both faces and top end of the second blade.

The blower fan comprises a sirocco fan.

In accordance with another aspect of the present invention, an air conditioner comprising: a housing having a suction port and a discharge port; a first blade arranged in the discharge port to regulate the flow of discharged air of the discharge port in a first direction; and a second blade arranged inside the housing to regulate the flow of discharged air of the discharge port in a second direction, wherein the second blade comprises a distribution guide formed to protrude from a side of the second blade to guide an air flow onto a first face and a second face of the first blade.

The distribution guide is arranged to be above the second blade.

The distribution guide comprises a curved plane.

The distribution guide is formed to protrude from both faces and top end of the second blade.

The distribution guide comprises a first guide face formed to guide an air flow onto the first face of the first blade, and a second guide face formed to guide an air flow onto the second face of the first blade.

The distribution guide is formed to incline from the second blade.

The distribution guide is arranged at the rear end of the second blade.

Advantageous Effects of Invention

According to embodiments of the present disclosure, an air conditioner may increase air volume and reduce dew condensation by making the flows of discharged air uniform and improving the distribution of discharged airflows by an airflow guide.

BEST MODE FOR CARRYING OUT THE INVENTION

Embodiments of the present disclosure will now be described in detail with reference to accompanying drawings. The terms "front", "rear", "upper", "lower", "top", and "bottom" as herein used are defined with respect to the drawings, but the terms may not restrict the shape and position of the respective components.

Figure 1:
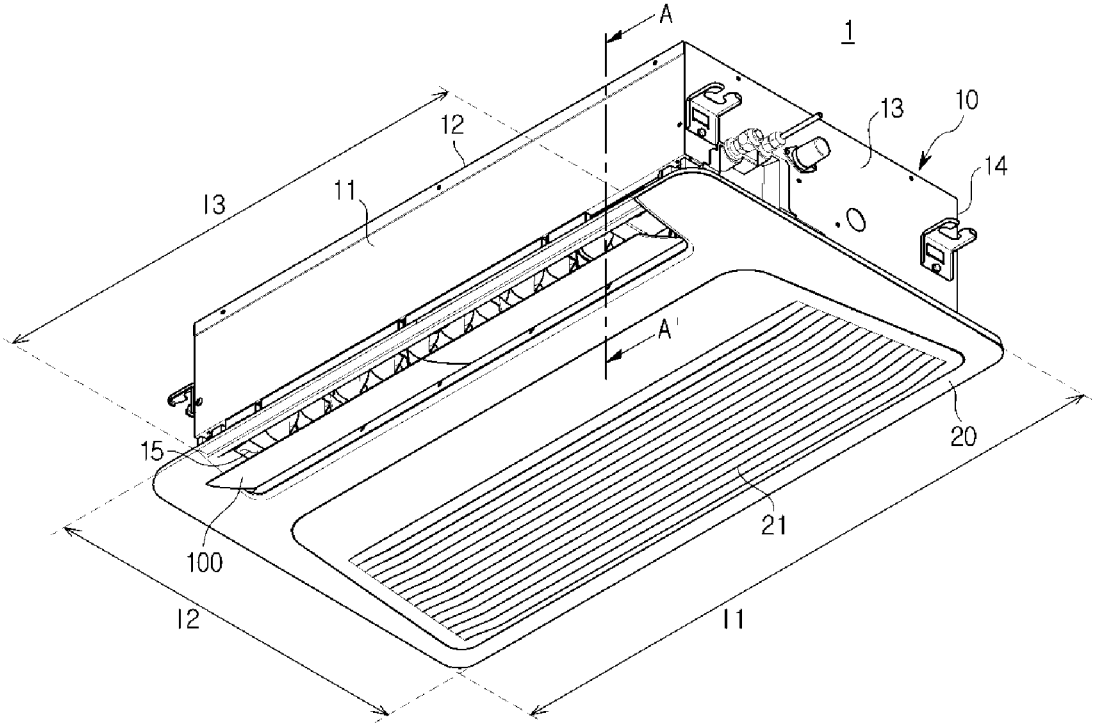
FIG. 1 shows an air conditioner, according to a first embodiment of the present disclosure.
Figure 2:
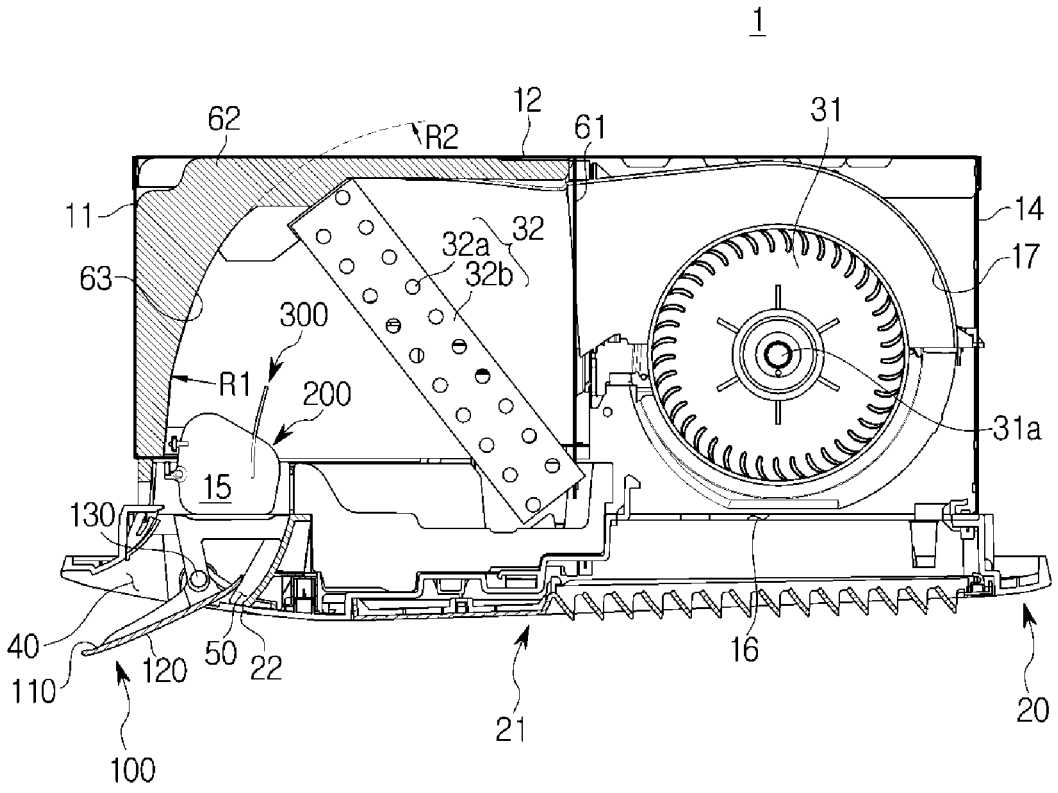
FIG. 2 is a cross-sectional view of portion A-A' of the air conditioner of FIG. 1, according to the first embodiment of the present disclosure.
Figure 3:
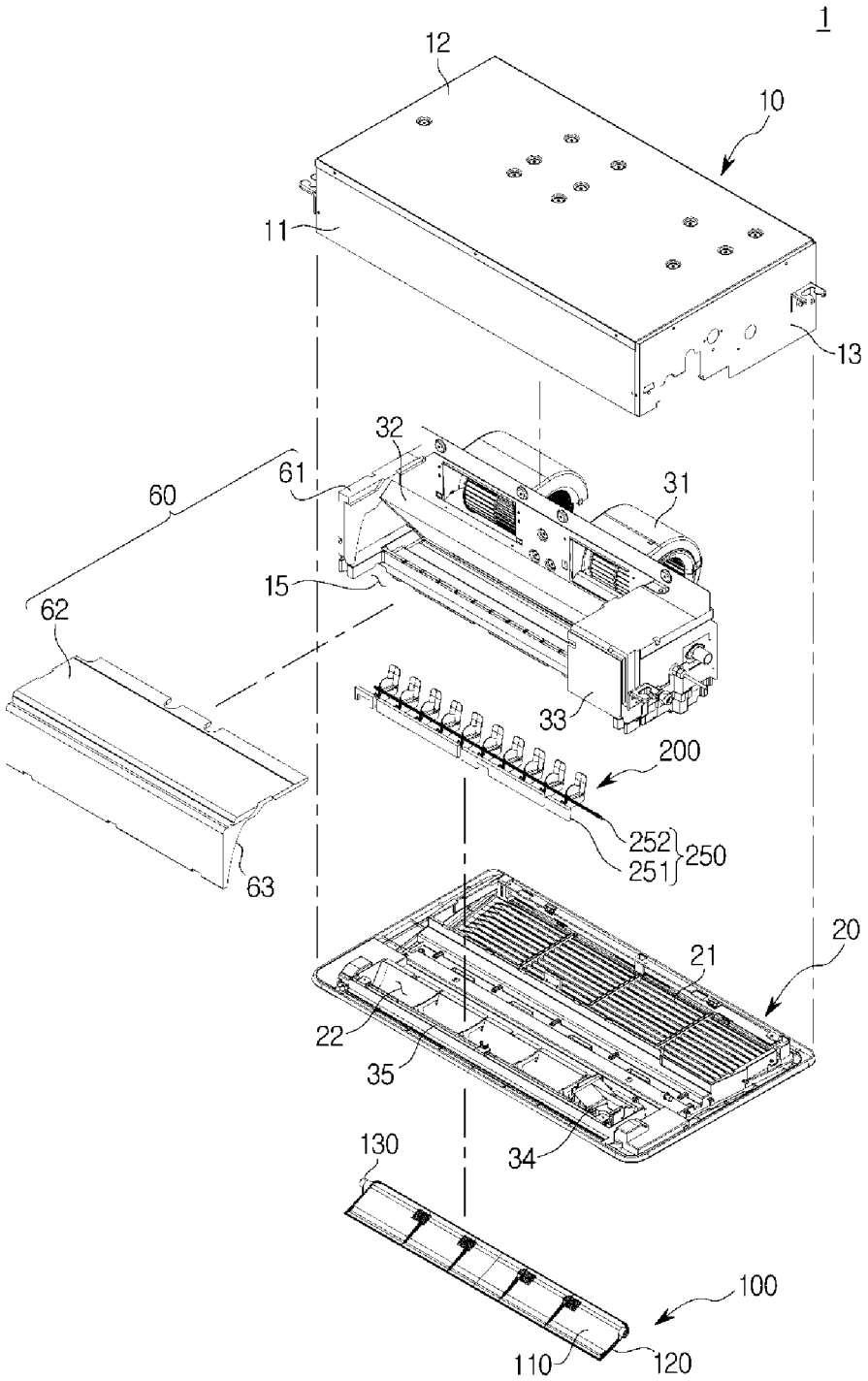
FIG. 3 is an exploded perspective view of the air conditioner, according to the first embodiment of the present disclosure.
Figure 4:
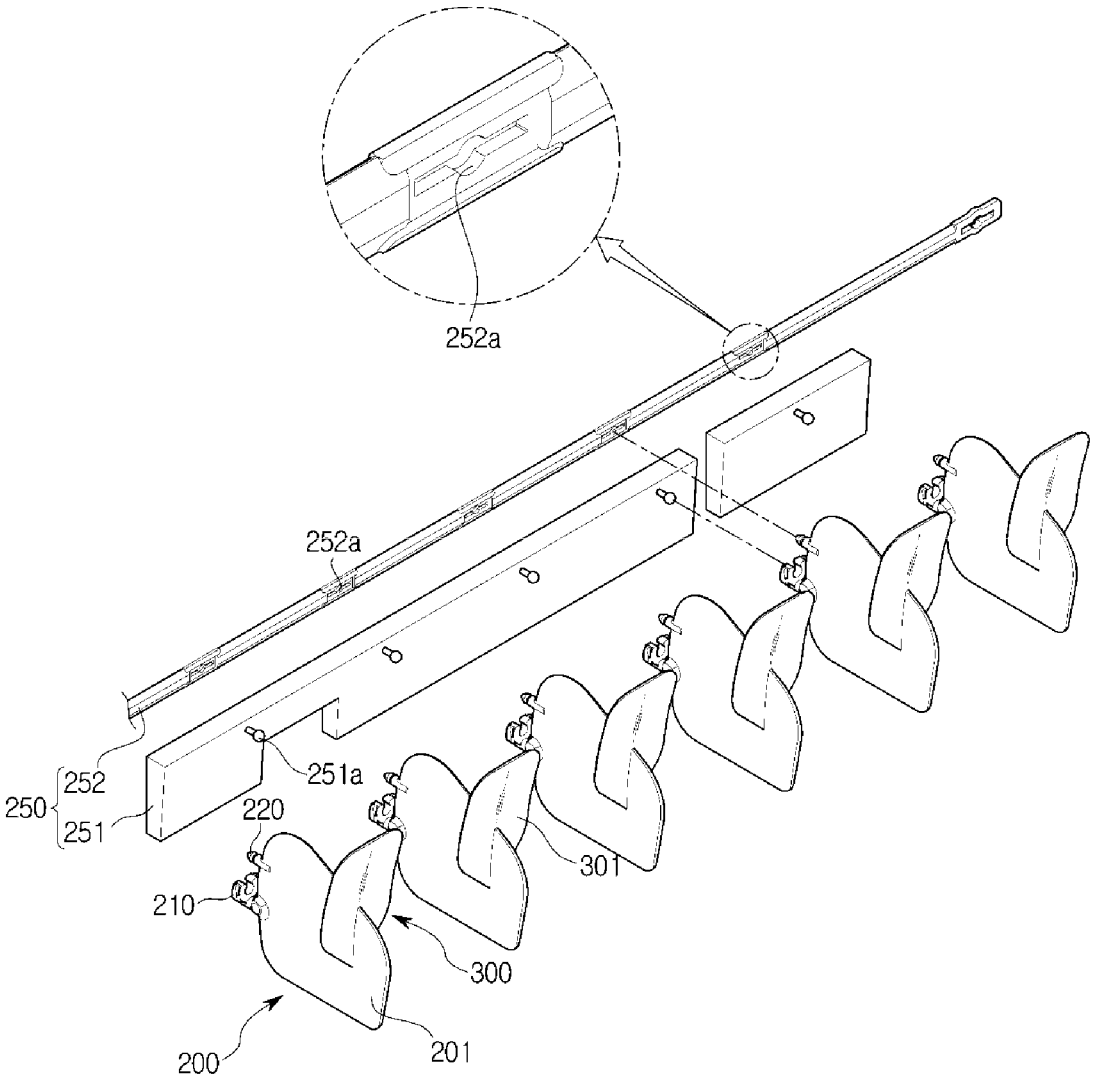
FIG. 4 shows a second blade with a third blade provided therein, according to the first embodiment of the present disclosure.

FIG. 1 shows an air conditioner, according to a first embodiment of the present disclosure, FIG. 2 is a cross-sectional view of portion A-A' of the air conditioner of FIG. 1, according to the first embodiment of the present disclosure, FIG. 3 is an exploded perspective view of the air conditioner, according to the first embodiment of the present disclosure, and FIG. 4 shows a second blade with a third blade provided therein, according to the first embodiment of the present disclosure.

Referring to FIGS. 1 to 4, an indoor unit 1 of an air conditioner includes a housing 10 provided to be hung on or buried in the ceiling, and a bottom panel 20 to be coupled with the housing 10.

The housing 10 has the form of almost a box. A heat exchanger 32 for exchanging heat between indoor air sucked in and a refrigerant and a blower fan 31 for forcing the air to be moved may be provided inside the housing 10.

The housing 10 includes a top side 12, a front side 11, a rear side 14, and left and right sides 13 that connect between the front side 11 and the rear side 14. The housing 10 may also include a guide rib 17 for guiding the air that has been heat-exchanged by the heat exchanger 32 toward a discharge port 15, and a scroll part 63.

A suction port 16 provided to suck in indoor air to the inside of the housing 10 and a discharge port 15 provided to discharge the heat-exchanged air back into the indoor space are arranged in the bottom portion of the housing 10.

There may be a frame 60 provided inside the housing 10. The frame 60 may be arranged to support and install the heat exchanger 32 and the blower fan 31. The frame 60 may include a first frame 61 and a second frame 62. The first frame 61 may include a motor housing 33 provided to cover a motor (not shown). The second frame 62 may form a flow path to guide the heat-exchanged air toward the discharge port 15 by covering a side of the heat exchanger 32. At least a portion of the inner face of the second frame 62 may form the scroll part 63. The scroll part 63 of the second frame 62 may be formed to have first curvature R1. A portion of the inner face of the second frame 62 may be formed to have the first curvature R1. A portion of the inner face of the second frame 62 may be formed to have second curvature R2.

The heat exchanger 32 may have a tube 32*a* through which the refrigerant flows, and a heat exchange fin 32*b* in contact with the tube 32*a* to expand the heating surface area. The heat exchanger 32 may be slantingly arranged to be substantially perpendicular to the direction of airflow.

The blower fan 31 may be arranged between the heat exchanger 32 and the suction port 16 and rotated by driving force of a driving motor (not shown) to force the air to be moved. A shaft 31*a* of the blower fan 31 may be arranged to be substantially horizontal to the ground. The blower fan 31 may include a sirocco fan.

The bottom panel 20 may include a rectangular plate. The bottom panel 20 may be first length wide 11 and second length long 12. The first length 11 and the second length 12 of the bottom panel 20 may be about 943~543 mm. The second length 12 of the bottom panel 20 may be about 545 mm or less. The bottom panel 20 may include a grill 21 arranged at a location corresponding to the suction port 16 to prevent a foreign material from flowing into the housing 10, and a panel discharge port 22 arranged at a location corresponding to the discharge port 15. A first blade 100 may be arranged in the panel discharge port 22 to open or close the panel discharge port 22 or regulate the flow of discharged air in a first direction (vertical direction). The first blade 100 may be pivotally arranged in the panel discharge port 22. The panel discharge port 22 is formed on the bottom panel 20 to be linked with the discharge port 15. The panel discharge port 22 is arranged on a side of the bottom panel 20. The panel discharge port 22 is arranged at a location corresponding to the discharge port 15. The panel discharger 22 may be third length wide 13, which is less than the first length 11 of the bottom panel 20. The third length 13 of the panel discharge port 22 may be about 746 mm. In the following description, the discharge port 15 and the panel discharge port 22 will be collectively called the discharge port 15.

The first blade 100 may be pivotally installed to open and shut the discharge port 15. The first blade 100 may have a shape corresponding to the discharge port 15. The first blade 100 may have the form of a plate. Specifically, the first blade 100 may be shaped like a rectangular plate. The first blade 100 may be pivotally positioned inside the discharge port 15. The first blade 100 may have a hinge shaft 130 on one side to pivot around in the discharge port 15.

The blade 100 includes a first face 110 and a second face 120, which is on the opposite side of the first face 110. The first face 110 may form the inner side of the first blade 100 and the second face 120 may form the outer side of the first blade 100. A first flow path 40 is formed between the first face 110 of the first blade 100 and the discharge port 15. A second flow path 50 is formed between the second face 120 of the first blade 100 and the discharge port 15.

There may be a second blade 200 provided to be movably installed inside the housing 10. The second blade 200 is placed in the discharge port 15 to regulate the discharged airflow to a second direction (left and right direction). The second blade 200 may be installed in a second blade installation portion 35 of the bottom panel 20. The second blade installation portion 35 may be formed to be adjacent to the panel discharge pot 22 of the bottom panel 20. A second blade coupling stalk 250 may be installed in the second blade installation portion 35, the second blade coupling stalk 250 being placed in front of the discharge port 15 and movably supporting the second blade 200. There may be a motor installation portion 34 provided on one side of the discharge port 15 for a motor (not shown) to be installed therein. The motor may be coupled to the second blade coupling stalks 250 to move the second blade 200 by generating driving force. The second blade 200 is moved by receiving the driving force from the motor through the second blade coupling stalk 250.

The second blade coupling stalk 250 includes a first coupling stalk 251 and a second coupling stalk 252. The second coupling stalk 252 is arranged above the first coupling stalk 251. The first coupling stalk 251 is fixed to the second blade installation portion 35. The second coupling stalk 252 is installed to be movable by the motor.

The first coupling stalk 251 is fixed to the second blade installation portion 35 to support the movement of the second blade 200. A plurality of second blade fixed protrusions 251*a* are separately formed on the first coupling stalk 251. The plurality of second blade fixed protrusions 251*a* are coupled to the blade panel 201 of the second blade 200, which will be described later, to support the movement of the second blade 200.

The second coupling stalk 252 may be coupled to the second blade 200 above the first coupling stalk 251. A coupling hole 252*a* may be formed in the second coupling stalk 252 for the second blade 200 to be coupled thereto. There may be a plurality of coupling holes 252*a*. The plurality of coupling holes 252*a* are separately arranged. The plurality of coupling holes 252*a* arranged at certain intervals are coupled to the blade panel 201 of the second blade 200, which will be described later, to support the movement of the second blade 200.

The second blade 200 is composed of a plurality of blade panels 201. The plurality of blade panels 201 each shaped like a plate are arranged at regular intervals.

The plurality of blade panels 201 are movably coupled to the second blade coupling stalk 250.

The blade panels 201 may each have the form of a trapezoid with the front end 200*e* longer than the rear end 200*d* and the top end 200*c* declining to the rear end 200*d*. The blade panel 201 may include a first face 20*a* and a second face 200*b* opposite of the first face 200*a*. The first face 200*a* and the second face 200*b* are formed in one unit.

The front end 200*e* of the blade panel 201 has a first height h1 and the rear end 200*d* has a second height h2. The first height h1 of the front end 200*e* is higher than the second height h2 of the rear end 200*d* (see FIG. 6).

A first coupler 210 and a second coupler 220 may be arranged on the front end 200*e* of the blade panel 201 to be coupled to the second blade coupling stalk 250.

The first coupler 210 may be coupled to the fixed protrusion 251*a* of the first coupling stalk 251. The fixed protrusion 251*a* of the first coupling stalk 251 may include a ball joint. The fixed protrusion 251*a* of the second blade coupling stalk 250 may be formed as a circular protrusion. The first coupler 210 may be formed as a circular hole corresponding to the fixed protrusion 251*a*. Accordingly, the second blade 200 may be rotated when the first coupler 210 is coupled with the fixed protrusion 251*a*.

The second coupler 220 may include a coupling protrusion that protrudes to be coupled with the coupling hole 252*a* of the second coupling stalk 252. The second coupler 220 of the second blade 200 is inserted and fixed to the coupling hole 252*a* of the second coupling stalk 252. The lower portion of the front end 200*e* of each blade panel 201 may be pivotally supported on the first coupling stalk 251. The upper portion of the front end 200*e* of each blade panel 201 is fixed to the second coupling stalk 252 and moved in the second direction with the movement of the second coupling stalk 252.

The second blade 200 includes a third blade 300 that protrudes from each blade panel 201. The third blade 300 is provided to uniformly distribute and guide the airflow of the discharge port 15 (hereinafter, the third blade implies a distribution guide). The third blade 300 uniformly distributes and guides the flow of cold air, which otherwise inclines upward and forward in the discharge port 15 by a sirocco fan.

Figure 5:
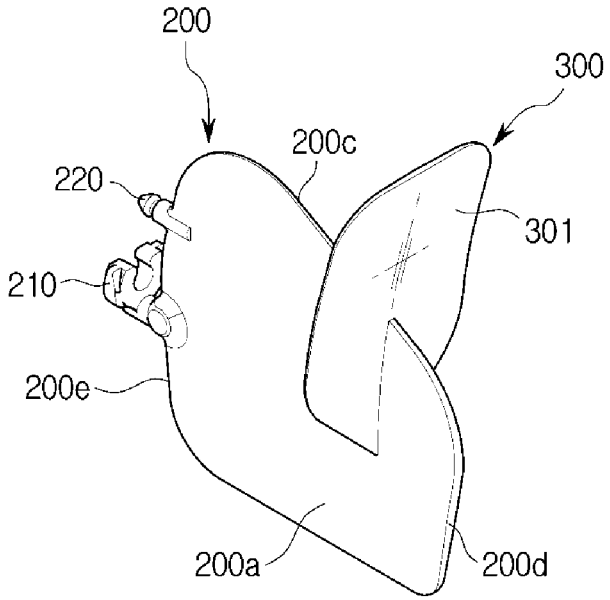
FIG. 5 is a perspective view of the third blade of the second blade, according to the first embodiment of the present disclosure.
Figure 6:
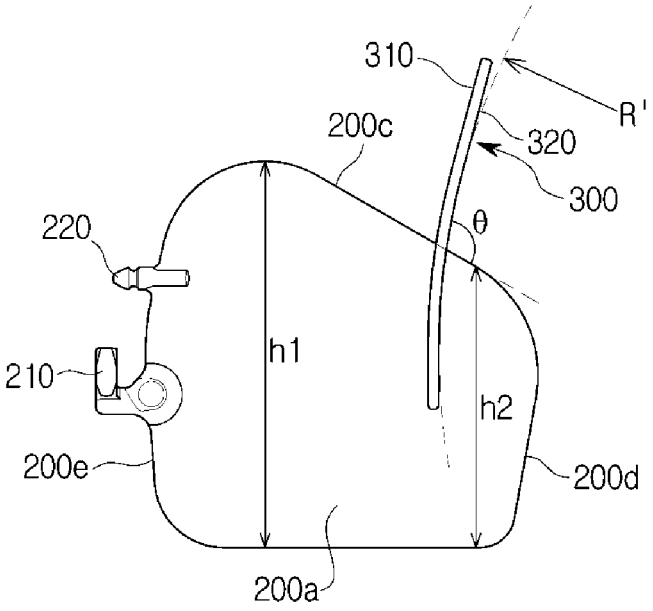
FIG. 6 is a side view of the third blade, according to the first embodiment of the present disclosure.
Figure 7:
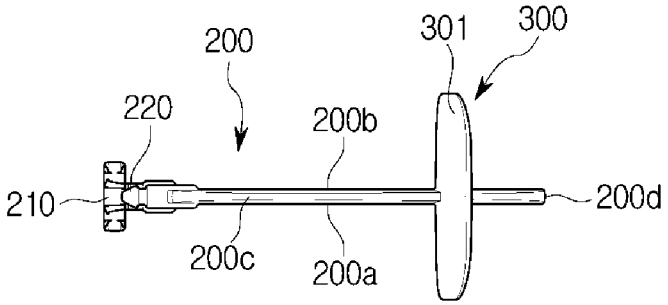
FIG. 7 is a top view of the third blade, according to the first embodiment of the present disclosure.

FIG. 5 is a perspective view of the third blade of the second blade, according to the first embodiment of the present disclosure, FIG. 6 is a side view of the third blade, according to the fifth embodiment of the present disclosure, and FIG. 7 is a top view of the third blade, according to the first embodiment of the present disclosure.

As shown in FIGS. 5, 6 and 7, the third blade 300 may be formed to protrude from the second blade 200. The third blade 300 is arranged to be above the second blade 200. The third blade 300 is arranged to be above the blade panel 201. The third blade 300 may be formed to protrude outwards from the first and second faces 200*a* and 200*b* of the second blade 200. The third blade 300 may be formed to protrude from the first and second faces 200*a* and 200*b* and the top end 200*c* of the second blade 200. The third blade 300 may be positioned to be perpendicular to the second blade 200. Again, the third blade 300 may protrude from both faces 200*a* and 200*b* of the second blade 200 and protrude from the top end 200*c* of the second blade 200.

The third blade 300 may have the form of a plate. The third blade 300 may include a plate-shaped blade body 301. The blade body 301 of the third blade 300 may include a first guide face 310 forming the front face and a second guide face 320 forming the rear face of the blade body 301.

The first guide face 310 of the third blade 300 is formed to guide the air to the first flow path 40 formed between the first face 110 of the first blade 100 and the discharge port 15. The second guide face 320 is formed to guide the air to the second flow path 50 formed between the second face 120 of the first blade 100 and the discharge port 15.

The third blade 300 may have a curved plane. The third blade 300 may have at least one of the first curvature R1 and the second curvature R2 formed on the inner side of the frame 60. The third blade 300 may be formed to have a curved plane with third curvature R'. The third blade 300 may be formed to have a curved plane with the second curvature R2.

The third blade 300 may be formed to incline at an angle θ from the second blade 200.

The third blade 300 is formed such that the first guide face 310 guides the air to the first flow path 40 and the second guide face 320 guides the air to the second flow path 50. Air volume may increase because the third blade 300 may uniformly distribute the air to the first and second flow paths 40 and 50.

Furthermore, the third blade 300 may uniformly distribute the air onto the first face 110 and the second face 120 of the first blade 100, making uniform movement of air around the first blade 100, thereby preventing a phenomenon of dew condensation on the first blade 100.

Figure 8:
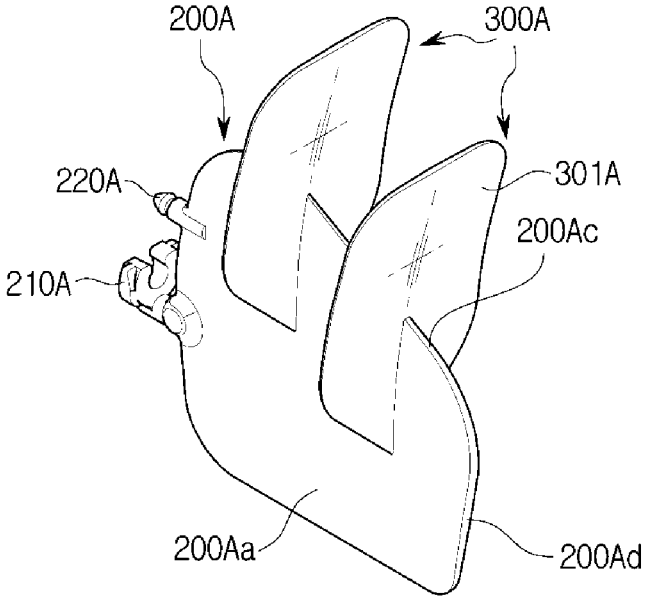
FIG. 8 is a perspective view of a third blade, according to a second embodiment of the present disclosure.
Figure 9:
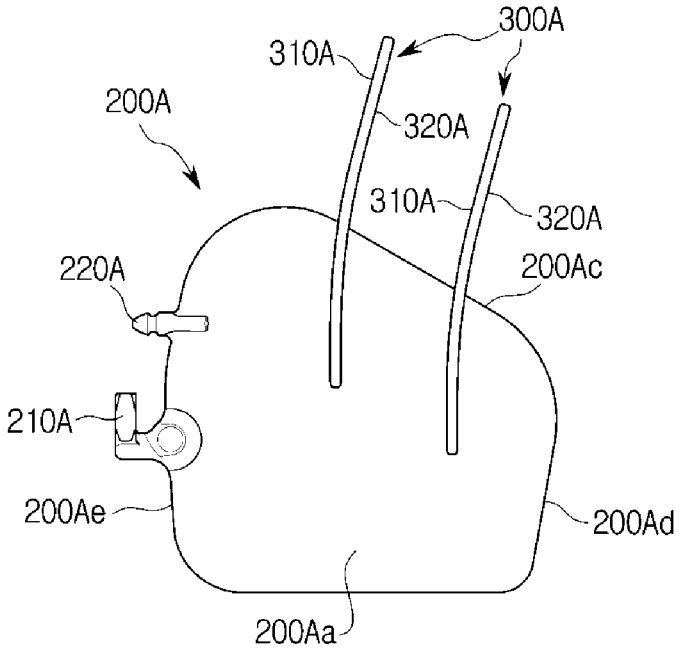
FIG. 9 is a side view of the third blade, according to the second embodiment of the present disclosure.

FIG. 8 is a perspective view of a third blade, according to a second embodiment of the present disclosure, and FIG. 9 is a side view of the third blade, according to the second embodiment of the present disclosure. Reference numerals not shown in FIGS. 8 and 9 may be referred to from FIGS. 1 to 7.

As shown in FIGS. 8 and 9, a third blade 300A may be formed to protrude from a second blade 200A. The third blade 300A is arranged to be above the second blade 200A. The third blade 300A may be formed to protrude outwards from first and second faces 200Aa and 200Ab of the second blade 200A. The third blade 300A may be formed to protrude from first and second faces 200Aa and 200Ab and the top end 200Ac of the second blade 200A.

The third blade 300A may be in the plural. The plurality of third blades 300A may be arranged on the second blade 200A at regular intervals. While two of the third blades 300A are shown to be arranged on the single second blade 200A in this embodiment, embodiments of the present disclosure are not limited thereto. For example, the number of the third blades 300A may be 2 or more.

The third blades 300A may include blade bodies 301A arranged to be separated from one another. Each blade body 301A may include a first guide face 310A forming the front face of the blade body 301A and a second guide face 320A forming the rear face of the blade body 301A. The first guide face 310A is formed to guide the air to the first flow path 40 formed between the first face 110 of the first blade 100 and the discharge port 15. The second guide face 320A is formed to guide the air to the second flow path 50 formed between the second face 120 of the first blade 100 and the discharge port 15.

Air volume may increase because the third blade 300A may uniformly distribute the air to the first and second flow paths 40 and 50.

Furthermore, the third blade 300 may uniformly distribute the air onto the first face 110 and the second face 120 of the first blade 100, making uniform movement of air around the first blade 100, thereby preventing a phenomenon of dew condensation on the first blade 100.

The structure and operation of the air conditioner with the third blade installed therein as described above may be fully anticipated from the above description, so the overlapping description will be omitted.

Figure 10:
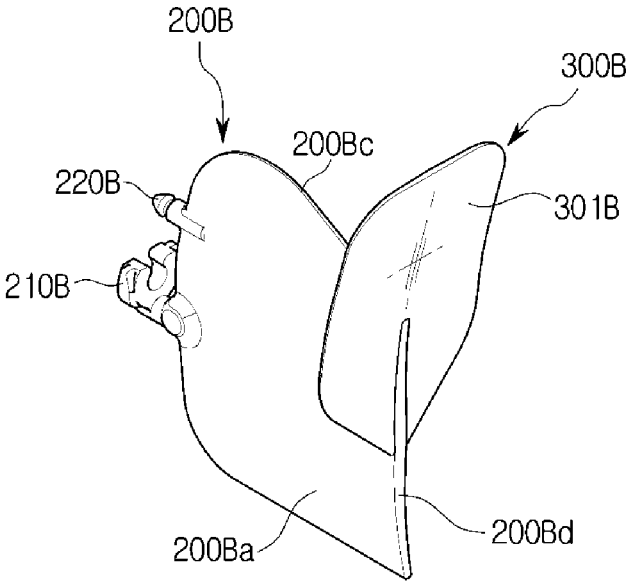
FIG. 10 is a perspective view of a third blade, according to a third embodiment of the present disclosure.
Figure 11:
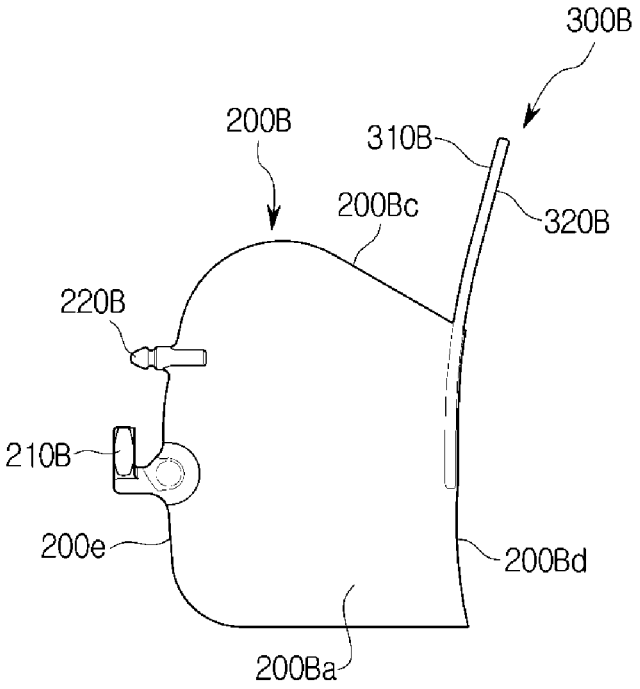
FIG. 11 is a side view of the third blade, according to the third embodiment of the present disclosure.
Figure 12:
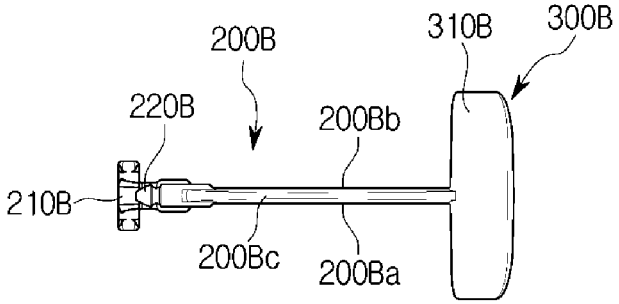
FIG. 12 is a top view of the third blade, according to the third embodiment of the present disclosure.

FIG. 10 is a perspective view of a third blade, according to a third embodiment of the present disclosure, FIG. 11 is a side view of the third blade, according to the fifth embodiment of the present disclosure, and FIG. 12 is a top view of the third blade, according to the third embodiment of the present disclosure. Reference numerals not shown in FIGS. 10, 11, and 12 may be referred to from FIGS. 1 to 7.

As shown in FIGS. 10, 11, and 12, a third blade 300B may be formed to protrude from a second blade 200B. The third blade 300B is arranged to be above the second blade 200B. The third blade 300B may be formed to protrude outwards from first and second faces 200Ba and 200Bb of the second blade 200B. The third blade 300B may be formed to protrude from the first and second faces 200Ba and 200Bb and the top end 200Bc of the second blade 200B. The third blade 300B is arranged upward from the rear end 200Bd of the second blade 200B.

The third blade 300B may include a blade body 301B. The blade body 301B may include a first guide face 310B forming the front face and a second guide face 320B forming the rear face.

The first guide face 310B of the third blade 300B is formed to guide the air to the first flow path 40 formed between the first face 110 of the first blade 100 and the discharge port 15.

The second guide face 320B of the third blade 300B is formed to guide the air to the second flow path 50 formed between the second face 120 of the first blade 100 and the discharge port 15. The second guide face 320B of the third blade 300B may extend from the rear end 200Bd of the second blade 200B on the same plane, and may thus be able to guide the air to the second flow path 50 easily.

Air volume may increase because the third blade 300B may uniformly distribute the air to the first and second flow paths 40 and 50. Furthermore, the third blade 300B may uniformly distribute the air onto the first face 110 and the second face 120 of the first blade 100, making uniform movement of air around the first blade 100, thereby preventing a phenomenon of dew condensation on the first blade 100.

The structure and operation of the air conditioner with the third blade installed therein as described above may be fully anticipated from the above description, so the overlapping description will be omitted.

Figure 13:
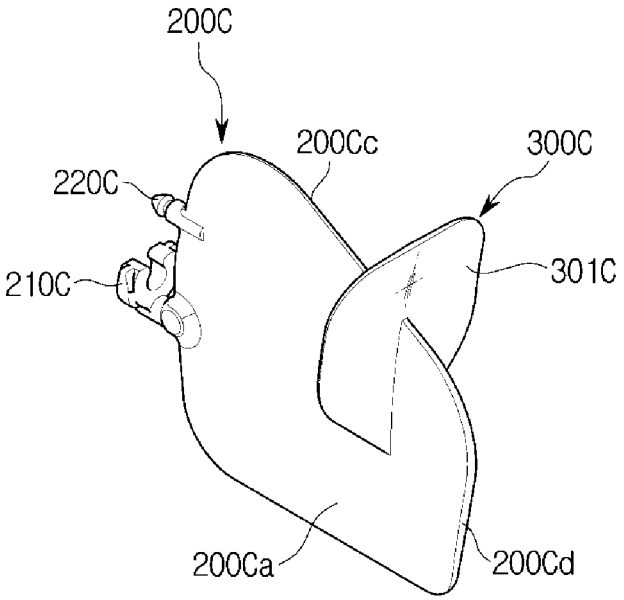
FIG. 13 is a perspective view of a third blade, according to a fourth embodiment of the present disclosure.
Figure 14:
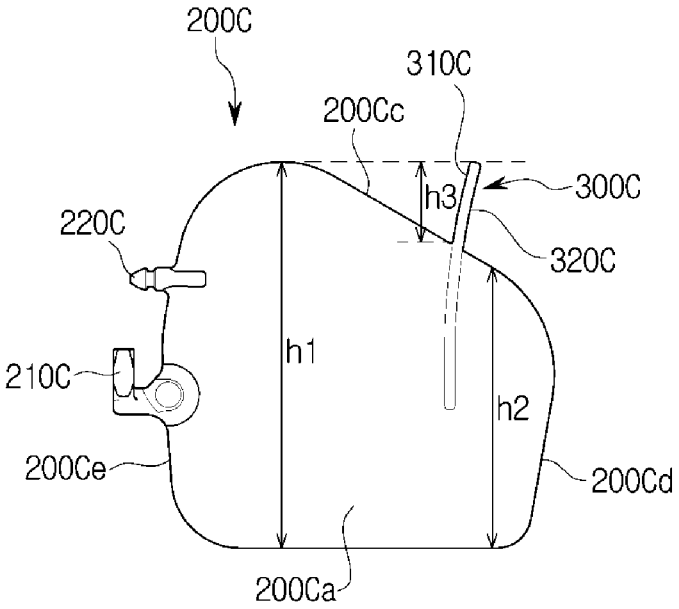
FIG. 14 is a side view of the third blade, according to the fourth embodiment of the present disclosure.

FIG. 13 is a perspective view of a third blade, according to a fourth embodiment of the present disclosure, and FIG. 14 is a side view of the third blade, according to the fourth embodiment of the present disclosure. Reference numerals not shown in FIGS. 13 and 14 may be referred to from FIGS. 1 to 7.

As shown in FIGS. 13 and 14, a third blade 300C may be formed to protrude from a second blade 200C. The third blade 300C is arranged to be above the second blade 200C. The third blade 300C may be formed to protrude outwards from first and second faces 200Ca and 200Cb of the second blade 200C. The third blade 300C may be formed to protrude outwards from the first and second faces 200Ca and 200Cb and the top end 200Cc of the second blade 200C. The third blade 300C protrudes upwards from a rear portion of the second blade 200C.

In this case, the third blade 300C protrudes as high as the top of the front end 200Ce of the second blade 200C. The second blade 200C is shaped like a trapezoid with the first height h1 of the front end 200Ce longer than the second height h2 of the rear end 200Cd. The front end 200Ce of the second blade 200C is formed to decline to the rear end 200Cd.

The third blade 300C may be arranged in a rear portion between the front end 200Ce and the rear end 200Cd of the second blade 200C and formed to protrude not higher than the first height h1 of the front end 200Ce.

The third blade 300C may include a blade body 301C. The blade body 301C may include a first guide face 310C forming the front face and a second guide face 320C forming the rear face.

The first guide face 310C of the third blade 300C is formed to guide the air to the first flow path 40 formed between the first face 110 of the first blade 100 and the discharge port 15.

Air volume may increase because the third blade 300C may uniformly distribute the air to the first and second flow paths 40 and 50. Furthermore, the third blade 300C may uniformly distribute the air onto the first face 110 and the second face 120 of the first blade 100, making uniform movement of air around the first blade 100, thereby preventing a phenomenon of dew condensation on the first blade 100.

The structure and operation of the air conditioner with the third blade installed therein as described above may be fully anticipated from the above description, so the overlapping description will be omitted.

Figure 15:
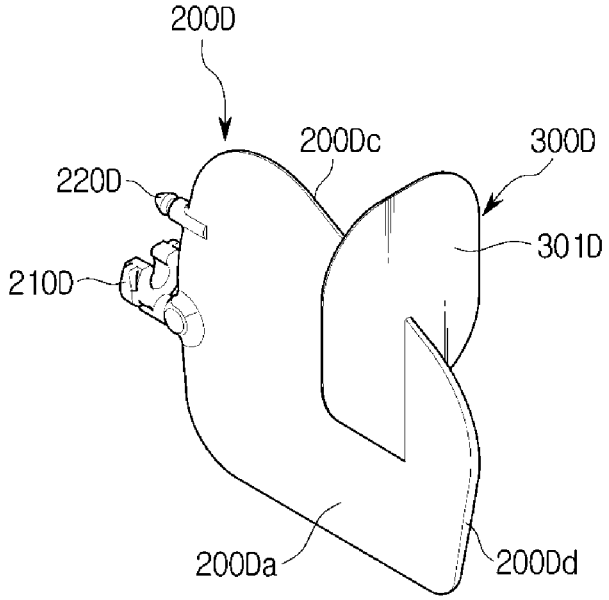
FIG. 15 is a perspective view of a third blade, according to a fifth embodiment of the present disclosure.
Figure 16:
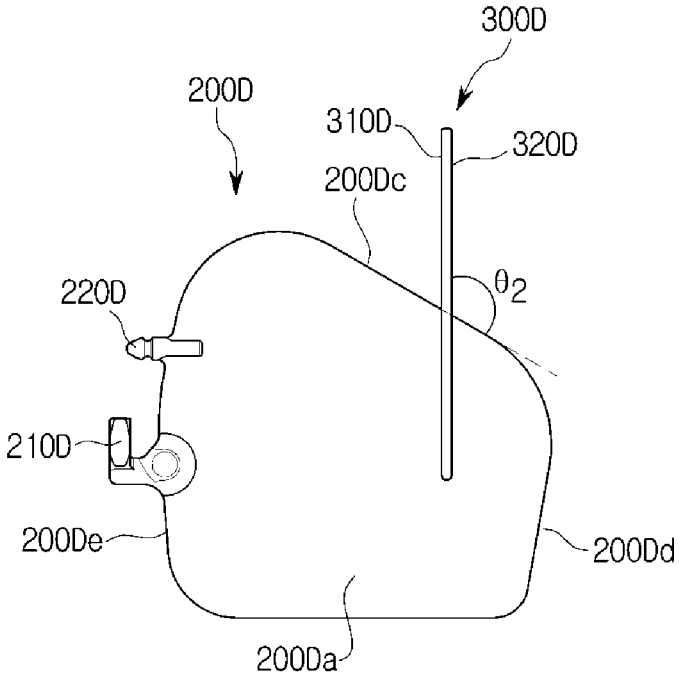
FIG. 16 is a side view of the third blade, according to the fifth embodiment of the present disclosure.

FIG. 15 is a perspective view of a third blade, according to a fifth embodiment of the present disclosure, and FIG. 16 is a side view of the third blade, according to the fifth embodiment of the present disclosure. Reference numerals not shown in FIGS. 15 and 16 may be referred to from FIGS. 1 to 7.

As shown in FIGS. 15 and 16, a third blade 300D may be formed to protrude from a second blade 200D. The third blade 300D is arranged to be above the second blade 200D. The third blade 300D may be formed to protrude outwards from first and second faces 200Da and 200Db of the second blade 200D. The third blade 300D may be formed to protrude from the first and second faces 200Da and 200Db and the top end 200Dc of the second blade 200D.

The third blade 300 may include a plate-shaped blade body 301D. The blade body 301D may include a first guide face 310D forming the front face and a second guide face 320D forming the rear face.

The third blade 300D may be arranged to form a second angle θ2 with the second blade 200D. The second angle θ2 may be greater than the first angle θ1.

The first guide face 310D of the third blade 300D is formed to guide the air to the first flow path 40 formed between the first face 110 of the first blade 100 and the discharge port 15. The second guide face 320D is formed to guide the air to the second flow path 50 formed between the second face 120 of the first blade 100 and the discharge port 15.

The third blade 300D is formed such that the first guide face 310D guides the air to the first flow path 40 and the second guide face 320D guides the air to the second flow path 50. Air volume may increase because the third blade 300D may uniformly distribute the air to the first and second flow paths 40 and 50. Furthermore, the third blade 300D may uniformly distribute the air onto the first face 110 and the second face 120 of the first blade 100, making uniform movement of air around the first blade 100, thereby preventing a phenomenon of dew condensation on the first blade 100.

The structure and operation of the air conditioner with the third blade installed therein as described above may be fully anticipated from the above description, so the overlapping description will be omitted.

According to embodiments of the present disclosure, an air conditioner may increase air volume and reduce dew condensation by making the flows of discharged air uniform and improving the distribution of discharged airflows by an airflow guide.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The invention claimed is:

1. An air conditioner comprising:

a housing having a suction port and a discharge port;

a heat exchanger arranged inside the housing;

a blower fan configured to suck in air through the suction port, force the air to be subject to heat exchange with the heat exchanger, and discharge the heat-exchanged air through the discharge port;

a first blade pivotally arranged to open or close the discharge port and having a first face and a second face opposite of the first face;

a first flow path formed between the discharge port and the first face;

a second flow path formed between the discharge port and the second face;

a second blade movably installed inside the housing; and a third blade having a blade body protruding from the second blade, the blade body having a first guide face forming a front face of the blade body to guide air to the first flow path, and a second guide face forming a rear face of the blade body to guide air to the second flow path, wherein the housing comprises a frame arranged therein, and the first guide face is perpendicular to the second blade and is parallel to an inner face of the frame.

2. The air conditioner of claim 1, wherein the third blade is formed to be perpendicular to the second blade.

3. The air conditioner of claim 2, wherein the third blade is arranged at the rear end of the second blade.

4. The air conditioner of claim 2, wherein the third blade is formed to protrude from both faces and top end of the second blade.

5. The air conditioner of claim 1, wherein the third blade is formed in the plural.

6. The air conditioner of claim 1, wherein the third blade is arranged to be above the second blade.

7. The air conditioner of claim 1, wherein the third blade comprises a curved plane.

8. The air conditioner of claim 1, wherein the third blade is formed to have the form of a plate.

9. The air conditioner of claim 1, wherein the third blade is formed to incline from the second blade.

10. The air conditioner of claim 1, wherein the inner side of the frame has a first curvature, and wherein the third blade has a curved plane with the first curvature.

11. The air conditioner of claim 1, wherein the blower fan comprises a sirocco fan.

* * * * *